US011671751B2

(12) United States Patent
Athineos et al.

(10) Patent No.: US 11,671,751 B2
(45) Date of Patent: Jun. 6, 2023

(54) MICROPHONE ARRAY

(71) Applicant: Sennheiser electronic GmbH & Co. KG, Wedemark (DE)

(72) Inventors: Marios Athineos, San Francisco, CA (US); Eugen Rasumow, Wedemark (DE); Alexander Krüger, Burgdorf (DE); Alexander Nowak, Hannover (DE)

(73) Assignee: SENNHEISER ELECTRONIC GMBH & CO. KG, Wedemark (DE)

( * ) Notice: Subject to any disclaimer, the term of this patent is extended or adjusted under 35 U.S.C. 154(b) by 99 days.

(21) Appl. No.: 17/242,556

(22) Filed: Apr. 28, 2021

(65) Prior Publication Data

US 2022/0353608 A1 Nov. 3, 2022

(51) Int. Cl.
*H04R 1/40* (2006.01)
*H04R 1/04* (2006.01)
(Continued)

(52) U.S. Cl.
CPC ..... *H04R 1/406* (2013.01); *H04R 1/04* (2013.01); *H04R 3/005* (2013.01); *G10L 25/18* (2013.01);
(Continued)

(58) Field of Classification Search
CPC ..... H04R 1/406; H04R 1/04; H04R 3/005; H04R 2201/12; H04R 2430/20;
(Continued)

(56) References Cited

U.S. PATENT DOCUMENTS 5,377,166 A * 12/1994 Kuhn ..... H04R 1/42 367/138
6,205,224 B1 3/2001 Underbrink
(Continued)

FOREIGN PATENT DOCUMENTS

DE 10 2010 012388 11/2010
JP 2006308409 11/2006

OTHER PUBLICATIONS

Li, Computational Acoustic Beamforming of Noise Source on Wind Turbine Foil (Year: 2014).*
(Continued)

*Primary Examiner* — Matthew A Eason
*Assistant Examiner* — Kuassi A Ganmavo
(74) *Attorney, Agent, or Firm* — Haug Partners LLP

(57) ABSTRACT

Microphone arrays comprise several microphone capsules, the outputs of which being electronically combined for directional recording of sound. The directional and frequency properties of the microphone array depend on the number and positions of the microphone array. In order to obtain the smallest possible microphone array with only few microphone capsules, which, however, has an essentially uniform directional and frequency dependence over a speech frequency range, is scalable and robust against small incorrect positioning of the capsules, fifteen or twenty-one microphone capsules ($K_{15,11}$-$K_{15,35}$, $K_{21,11}$-$K_{21,37}$) are arranged on a carrier such that they lie on three similar branches, each with the same number of microphone capsules, which are rotated against each other by 120°. Each of the microphone capsules lies on a corner of a triangle of a grid in a flat isometric coordinate system with three axes rotated by 120° against each other and forming the grid of equilateral triangles.

9 Claims, 4 Drawing Sheets

(51) Int. Cl.

| | |
|---|---|
| ***H04R 3/00*** | (2006.01) |
| ***H04R 9/08*** | (2006.01) |
| ***H04R 1/08*** | (2006.01) |
| ***H04R 29/00*** | (2006.01) |
| ***G10L 25/18*** | (2013.01) |
| ***H04R 5/027*** | (2006.01) |
| ***H04R 9/02*** | (2006.01) |

(52) U.S. Cl.
CPC ..... *H04R 1/08* (2013.01); *H04R 5/027* (2013.01); *H04R 9/025* (2013.01); *H04R 9/08* (2013.01); *H04R 29/004* (2013.01); *H04R 2201/40* (2013.01); *H04R 2203/12* (2013.01); *H04R 2307/027* (2013.01); *H04R 2430/20* (2013.01); *H04S 2400/15* (2013.01)

(58) Field of Classification Search
CPC .. H04R 2307/027; H04R 5/027; H04R 9/025; H04R 9/08; H04R 29/004; H04R 1/08; H04R 2201/401; G10L 25/18; H04S 2400/15
See application file for complete search history.

(56) References Cited

U.S. PATENT DOCUMENTS

| | | | | |
|---|---|---|---|---|
| 8,213,634 | B1 * | 7/2012 | Daniel | H04R 3/005 381/91 |
| 8,787,114 | B1 * | 7/2014 | Plotke | G01S 3/8006 367/119 |
| 9,143,879 | B2 * | 9/2015 | McElveen | H04S 3/002 |
| 9,894,434 | B2 | 2/2018 | Rollow, IV et al. | |
| 2013/0101136 | A1 * | 4/2013 | McElveen | H04R 1/02 381/92 |
| 2013/0101141 | A1 * | 4/2013 | McElveen | H04R 1/406 381/123 |
| 2015/0117672 | A1 * | 4/2015 | Christoph | H04R 3/005 381/92 |
| 2016/0323668 | A1 * | 11/2016 | Abraham | H04R 1/02 |
| 2018/0139535 | A1 * | 5/2018 | Cengarle | H04R 3/005 |

OTHER PUBLICATIONS

International Search Report and Written Opinion dated Aug. 12, 2022 in the corresponding International application No. PCT/EP2022/060420.

* cited by examiner

MICROPHONE ARRAY

FIELD OF DISCLOSURE

The present invention relates to a microphone array, in particular an arrangement of a plurality of microphone capsules that operate together to pick up sound.

BACKGROUND

Microphone arrays are frequently used e.g. for beamforming, for noise suppression or for searching an acoustic source. They comprise several microphone capsules, the output signals of which are electronically interconnected in order to work together for the directional recording of sound. The type of interconnection can produce a preferred direction in which the sensitivity of the microphone array for audio recording is particularly high. Due to the electronic combination of the individual microphone signals, this preferred direction can be adjusted electronically, which enables the preferred direction to be changed with a very short response time. However, a microphone array does not necessarily have equally good directional effects for all directions, but often has one or more fixed preferred directions that depend on the arrangement of the microphone capsules. In addition, microphone arrays do not work equally for all frequencies, but rather show a frequency dependency. This depends, among other things, on the distance between the microphone capsules. A very important aspect of a microphone array is therefore the geometric arrangement of the microphone capsules on the microphone surface: With a given number of microphone capsules, these should cover as many inter-element distances as possible, i.e. distances between individual microphone capsules of an array, in as many different directions as possible.

There are various strategies with regard to the type, number and positioning of the microphone capsules. Often, for example for microphone arrays that can be mounted on room ceilings, a large number of microphone capsules are combined with one another in order to be able to capture as many different preferred directions as possible and a specific frequency range. This is often the range of speech frequencies, e.g. 100 Hz-10 kHz. Typical approaches in this field are heuristic and therefore very time-consuming searches by "trying out" all conceivable analytically describable manifolds, such as lines, circles, spirals etc., and numerical simulation.

For example, in U.S. Pat. No. 6,205,224 B1 at least 63 sensor elements such as antennas or microphone capsules are arranged on concentric circles and at the same time on spirals in order to enable broadband detection that is largely independent of direction and that has a high degree of directivity. The directional and frequency properties of a sensor arrangement are indicated by means of a so-called coarray, which shows inter-element distances and the direction of these distances. In US2013/0101141 A1, which also aims at direction-independent and broadband detection, thirty microphone capsules are evenly distributed over the surface of a hexagonal circuit board, several of which can then be interconnected. In US2016/0323668 A1, too, numerous microphone capsules are interconnected to form a microphone array and are largely evenly distributed over several circuit boards. A central board contains 64 microphone capsules, while each of 7 boards arranged in a circle around it contains a further 8 microphone capsules, which leads to a total of 120 microphone capsules. In all these cases, the large number of microphone signals leads to a high computational effort and an overall large microphone array results.

Another strategy than in the documents mentioned is therefore to use as few microphone capsules as possible for an array. In order to reduce the noise in this case, or to obtain a high signal-to-noise ratio (SNR) respectively, the microphone capsules must have as little noise as possible, i.e. be of high quality. Furthermore, the electroacoustic properties of all microphone capsules in an array must be largely identical within tight tolerances. A number-theoretical approach to minimizing the number of microphone capsules and their positioning is pursued in DE10 2010 012388 A1, by positioning them at the intersections of Golomb rulers. Although this leads to a reduction in the number of microphone capsules, it also leads to a directional characteristic that is not uniform in all directions, due to the asymmetric distribution. Moreover, the microphone capsules are almost evenly distributed over the entire surface. In U.S. Pat. No. 9,894,434 B2, a microphone array with 17 microphone capsules is described which are arranged on the diagonals of a relatively large square area of approximately 60×60 cm. This size is typical for most of the arrays mentioned. Furthermore, most of the arrays mentioned have the problem that they are susceptible to even small incorrect positioning of the microphone capsules and cannot be scaled in size without disruptive non-linear effects occurring.

In the field of seismology, investigations into sensor arrays were carried out a long time ago. In the article "Array Design" by R. Haubrich in the "Bulletin of the Seismological Society of America", Vol. 58, June 1968, it is described how arrays for the detection of seismic waves, ocean waves or electromagnetic radio waves can be constructed with as few sensors as possible. The directional and frequency properties of various sensor arrangements are assessed using coarrays. Various sensor arrangements that are considered to be "perfect" or "optimal" according to this criterion are proposed, including isometric arrays, the sensors of which are located at the intersections of an isometric coordinate system.

SUMMARY OF THE INVENTION

The invention is based on the object of providing a microphone array which is as small as possible and has as few microphone capsules as possible, but is more robust against small incorrect positioning of the capsules, has a high and direction-independent directivity and an essentially uniform frequency dependence over a speech frequency range, and which can be used as a ceiling microphone. This object is solved by a microphone array according to claim 1.

As it turned out, the structures of some of the arrays of seismic sensors proposed by R. Haubrich many years ago are also suitable for arrays of microphone capsules. In particular, isometric arrays with fifteen or twenty-one microphone capsules have particularly good acoustic properties, such as e.g. good localization of sound sources and a high level of directivity, as well as other advantages, e.g. low manufacturing costs. This applies even if the size of the arrays is scaled down according to the speech frequencies to be recorded, so that smaller arrays than before are possible.

According to the invention, a microphone array has a small number of microphone capsules, in particular fifteen or twenty-one microphone capsules, and a circuit arrangement which is connected to the microphone capsules and which is suitable for receiving the microphone signals and for processing them together. The microphone capsules are arranged in a plane at certain positions on a carrier board, namely on three similar (i.e. in principle identical) branches each with the same number of microphone capsules, the branches being rotated by 120° from one another around a common center, and wherein, in a flat isometric coordinate system with three axes rotated by 120° against each other which form a so-called L2-grid (L2-lattice) of equilateral triangles, each of the microphone capsules lies on a corner of a triangle of the L2-grid. The use of electret capsules is particularly advantageous, since they typically have less inherent noise and lower self-resonance and can cover a higher sound pressure level range. However, other microphone capsules can also be used, e.g. MEMS.

One advantage of the array according to the invention is the good and uniform directivity over the entire relevant speech frequency range and in all directions, as can be calculated using coarrays. However, further advantages of the array according to the invention also include the relatively high robustness with respect to small incorrect positioning of microphone capsules, the small size of the array and thus lower costs, as well as the relatively free possibility of size scaling.

Further advantageous embodiments are disclosed in the claims 2-11.

BRIEF DESCRIPTION OF THE DRAWINGS

Further details and advantageous embodiments are depicted in the drawings, showing in FIG. 1 shows an arrangement of fifteen microphone capsules in a first embodiment of the invention.

DETAILED DESCRIPTION OF PREFERRED EMBODIMENTS

Figure 1:
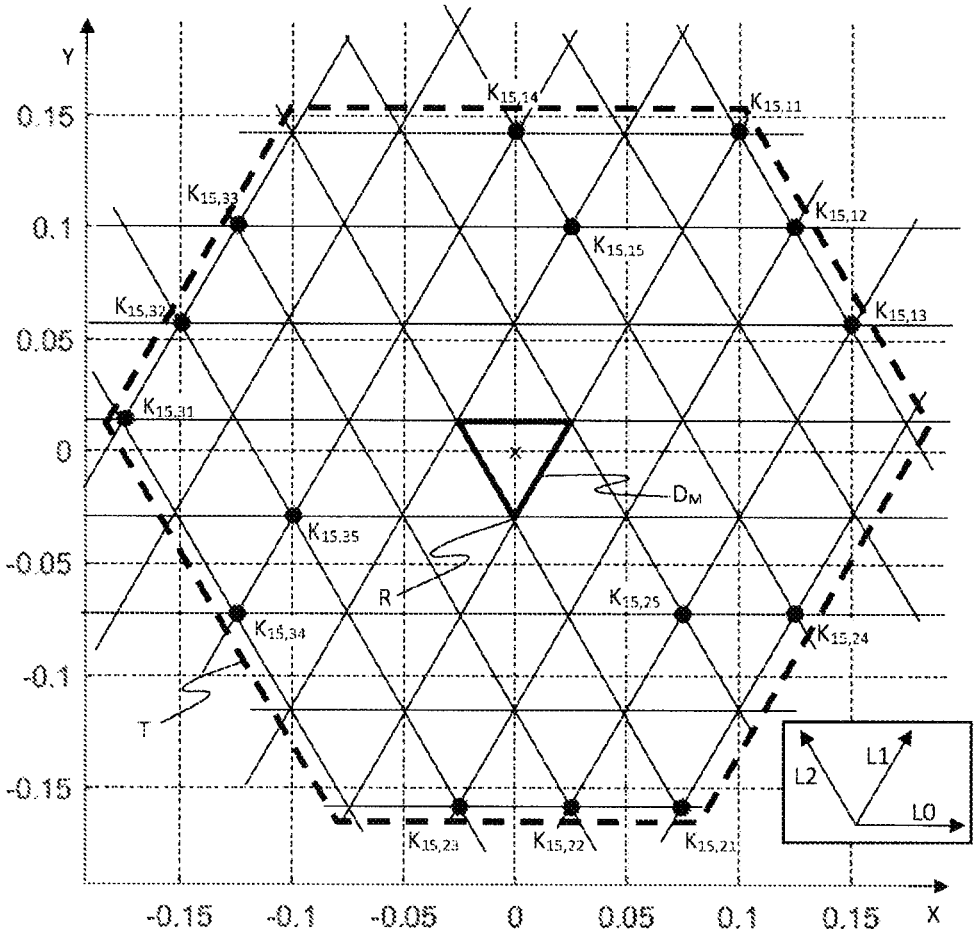

In a first embodiment of the invention, FIG. 1 shows an arrangement of fifteen microphone capsules on a carrier T. The microphone capsules are arranged in three equal groups on congruent branches, each of which is rotated by 120° in relation to one another. The first branch comprises e.g. the capsules $K_{15,11}$, $K_{15,12}$, $K_{15,13}$, $K_{15,14}$ and $K_{15,15}$. The second branch comprises the capsules $K_{15,21}$-$K_{15,25}$ and the third branch comprises the capsules $K_{15,31}$-$K_{15,35}$. A Cartesian coordinate system X,Y is indicated for orientation, but the capsules lie on the intersection points of an isometric coordinate system, which is also indicated in FIG. 1. The isometric coordinate system has three axes L0, L1, L2 offset by 60° in one plane and consists of equilateral triangles. The sides of each of these triangles are each parallel to one of the axes L0, L1 or L2. The center of the entire arrangement, around which the three congruent branches are rotated against each other, is the origin of the Cartesian coordinate system (i.e. X=0, Y=0). At the same time, it is also the center of gravity of a central triangle $D_M$ of the isometric coordinate system. That corner of the central triangle $D_M$ that is opposite its side parallel to the L0 axis is arbitrarily chosen here as the reference point R of the isometric coordinate system.

Positions in the isometric coordinate system are specified as multiples of the side lengths of the equilateral triangles. For example, the upper right corner of the center triangle $D_M$ is shifted from the reference point R by only one side length in the direction of the L1 axis, which is specified in isometric coordinates as position (L0,L1,L2)=(0,1,0). Correspondingly, the upper left corner of the center triangle $D_M$ is shifted from the reference point R by only one side length in the direction of the L2 axis, i.e. at the position (L0,L1,L2)=(0,0,1) in isometric coordinates. Starting from the reference point R, the microphone capsules are at the following positions:

| Branch 1: | | Branch 2: | | Branch 3: | |
|---|---|---|---|---|---|
| $K_{15,11}$ | (0, 4, 0) | $K_{15,21}$ | (0, 0, −3) | $K_{15,31}$ | (−3, 0, 1) |
| $K_{15,12}$ | (1, 3, 0) | $K_{15,22}$ | (0, −1, −2) | $K_{15,32}$ | (−2, 0, 2) |
| $K_{15,13}$ | (2, 2, 0) | $K_{15,23}$ | (0, −2, −1) | $K_{15,33}$ | (−1, 0, 3) |
| $K_{15,14}$ | (0, 2, 2) | $K_{15,24}$ | (2, 0, −1) | $K_{15,34}$ | (−2, −1, 0) |
| $K_{15,15}$ | (0, 2, 1) | $K_{15,25}$ | (1, 0, −1) | $K_{15,35}$ | (−2, 0, 0) |

In Cartesian coordinates (X,Y), this results in approximately the following values, depending on the scale (for example for a side length of the triangles, or isometric length unit respectively, of 0.05 m, as shown in FIG. 1; unit: meter):

| | | |
|---|---|---|
| $K_{15,11}$ (0.100, 0.144) | $K_{15,21}$ (0.075, −0.159) | $K_{15,31}$ (−0.175, 0.014) |
| $K_{15,12}$ (0.125, 0.101) | $K_{15,22}$ (0.025, −0.159) | $K_{15,32}$ (−0.150, 0.058) |
| $K_{15,13}$ (0.150, 0.058) | $K_{15,23}$ (−0.025, −0.159) | $K_{15,33}$ (−0.125, 0.101) |
| $K_{15,14}$ (0.000, 0.144) | $K_{15,24}$ (0.075, −0.072) | $K_{15,34}$ (−0.125, 0.072) |
| $K_{15,15}$ (0.025, 0.101) | $K_{15,25}$ (0.125, −0.072) | $K_{15,35}$ (−0.100, −0.029) |

The scale is to be chosen such that the smallest distance between two microphone capsules corresponds to a side length of a triangle of the isometric coordinate system. Thus, the microphone array depicted in FIG. 1 has a diameter of about 35 cm.

The positions apply to the coordinate systems indicated in FIG. 1 and, naturally, deviate numerically when the coordinate systems or the array are rotated or when another reference point is selected. Moreover, the positions can be reached in different ways in the isometric coordinate system (since the axes are not orthogonal to each other), which leads to different, but equivalent coordinates. For example, (1,1,0), (0,2,−1), (2,0,1), (3,−1,2) and other further coordinates define the same point. Some equivalent variants can be mapped onto the arrangement shown in FIG. 1 by rotating around the center point.

Figure 2:
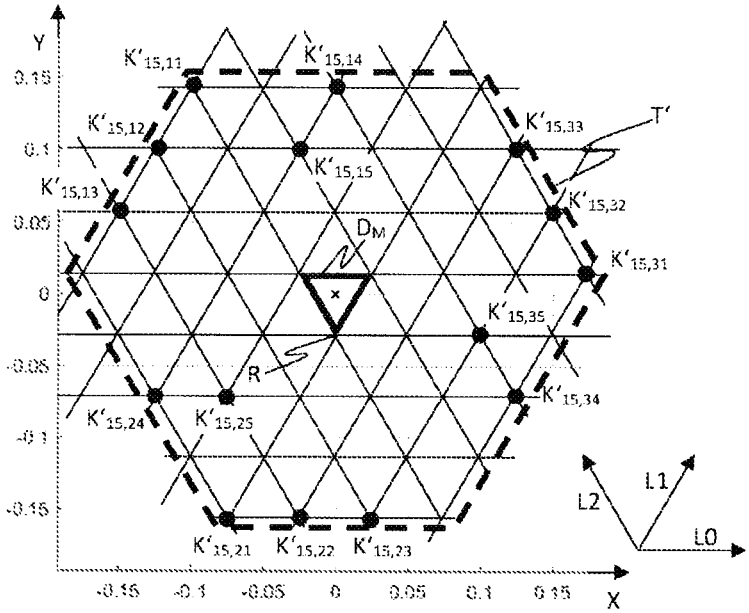
FIG. 2 shows an arrangement of fifteen microphone capsules in a second embodiment of the invention which is mirror-symmetrical to the first embodiment.

FIG. 2 shows an arrangement of fifteen microphone capsules on a carrier T' in a second embodiment of the invention which is mirror-symmetrical to the first embodiment. It has the same acoustic and geometric properties as the arrangement of the first embodiment and is equivalent to it. The mirror symmetry exists here along the Y-axis. However, identical but rotated variants can be produced by mirroring the arrangement according to the first embodiment on any axis. Because the sensitivity of the array can be adjusted largely uniformly in all directions, all of these variants are equivalent, i.e. they result in the same coarray, and are therefore identical either with the first or the second embodiment. The isometric coordinate system can be determined, for example, for a given arrangement or a given base area in that three positions on the outer edge lie on a straight line (e.g. $K_{15,11}$, $K_{15,12}$, $K_{15,13}$ or $K'_{15,21}$, $K'_{15,22}$, $K'_{15,23}$) that is parallel to one of the axes L0,L1,L2 of the isometric coordinate system. The distances between two adjacent positions in this group of three correspond to the side lengths of the triangles and thus to a unit of the isometric coordinate system.

Figure 3:
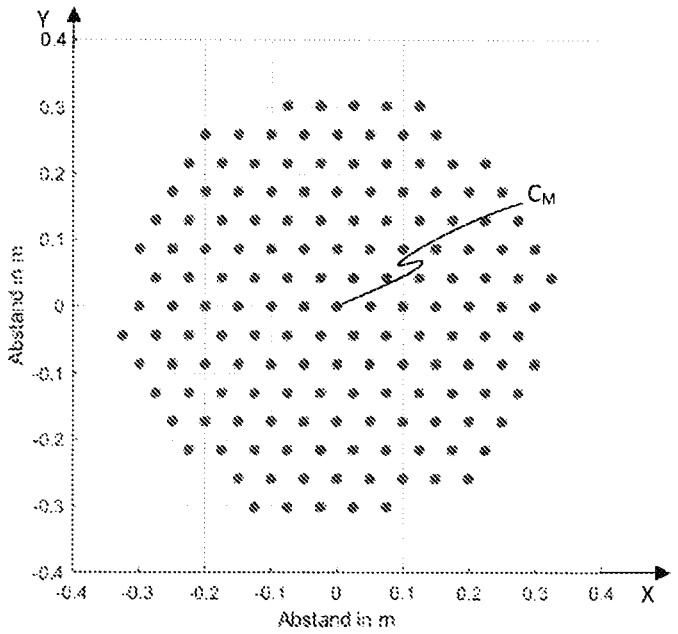
FIG. 3 shows a coarray of an arrangement of microphone capsules according to the first or second embodiment.

FIG. 3 shows the coarray of the arrangement according to the first as well as the second embodiment, which is in principle known from R. Haubrich's theory but adapted here for sound waves of speech sound, or speech frequencies respectively. The points represent the relative position of two microphone capsules of the array to one another, that is, the distances between them and the directions of these distances. In other words, each point in the coarray means that there is at least one pair of microphone capsules in the array whose position relative to one another is the same as the position of this coarray point relative to the coarray center point $C_M$. Each point thus also represents a possible direction of incidence and wavelength of sound waves, which can be processed by the microphone array exactly according to their direction, i.e. which can be used to locate a sound source and generate a directional effect. It is important here that no holes occur in the coarray at points of the isometric coordinate system. This is true here. A hole in the coarray would mean that the microphone array could not process sound waves of the corresponding direction of incidence and wavelength in a directionally accurate manner. Usually, however, it is not possible to infer an unambiguously associated microphone arrangement directly from a coarray.

The coarray of the microphone arrangement according to the invention has the advantageous property that (at least in the inner region of the coarray) each coarray point has six neighboring points arranged evenly around it, each at the same distance. This allows the size of the microphone arrangement to be scaled to the wavelengths of interest. The coarray points with the smallest distance to the origin (smallest inter-element distances) indicate the highest frequency that is spatially clearly resolvable, before undersampling begins, i.e. below the so-called spatial aliasing. The coarray points with the greatest distance to the origin correspondingly determine the beamformer's performance for low frequencies. As a result, the smallest inter-element spacing of the microphone arrangement can be scaled to the smallest wavelength or highest frequency of interest, while the closest possible coverage of all wavelengths is maintained for all larger inter-element spacings or larger wavelengths, respectively. For example, scaling the microphone arrangement of the first or second embodiment to a diameter of 35 cm (L=5 cm) results in a highest frequency (below spatial aliasing) of approximately 6.9 kHz.

One advantage of the invention is that the microphone capsules are not evenly distributed over the entire area of the array, but rather from groups. This means that relatively large parts of the surface do not have to be covered by circuit boards or printed circuit boards for contacting the capsules. In particular, it is not necessary to provide a circuit board or group of circuit boards in the size of the entire arrangement. This further reduces the manufacturing costs for the array, which are relatively low due to the small number of microphone capsules, and its weight. In addition, since the microphone capsules are distributed over three congruent branches, equal circuit boards can also be used for each branch.

Figure 4:
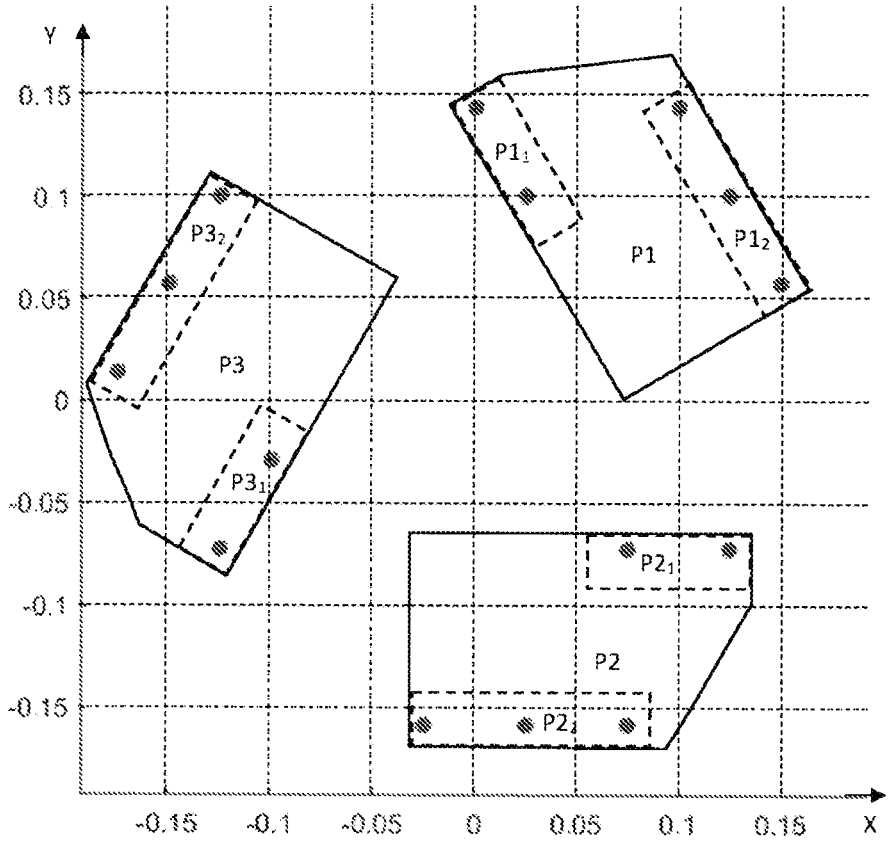
FIG. 4 shows an exemplary arrangement of circuit boards for an arrangement of the microphone capsules according to the first embodiment.

FIG. 4 shows an exemplary arrangement of three identical circuit boards P1,P2,P3 for an arrangement of the microphone capsules according to the first embodiment. The circuit boards P1-P3, each containing five microphone capsules of a branch, are each rotated by 120° and arranged on a carrier. Further components such as a processing unit with one or more processors, AD converters etc. may also be arranged on these circuit boards. In particular, however, it is also possible to accommodate at least some of these additional components on an additional circuit board (not shown) which is located in the middle and is connected to the circuit boards P1-P3 carrying the capsules. For this, it is another advantage of this arrangement that there is no microphone capsule in the middle, so that there is enough space for a central circuit board. This means that no stacking of circuit boards is necessary in this area, which would make the array thicker, more complex to manufacture and therefore more expensive. Further, the fundamentally symmetric structure ensures that the center of gravity of the entire array is in the middle, which makes assembly easier. In addition, it is possible to replace each of the three boards P1-P3 with, for example, two sub-boards $P1_1$,$P1_2$,$P2_1$,$P2_2$,$P3_1$,$P3_2$ each, in order to reduce the total board area. This is advantageous if the total area of the array and thus of the (sub) boards is large compared to the area required for the components. Here, too, at least three sub-boards are identical, e.g. $P1_1$, $P2_1$ and $P3_1$. Depending on the space requirements for the further components, it is possible that the circuit boards (or at least the capsule-carrying circuit boards) all together make up less than half of the total area of the array.

Figure 5:
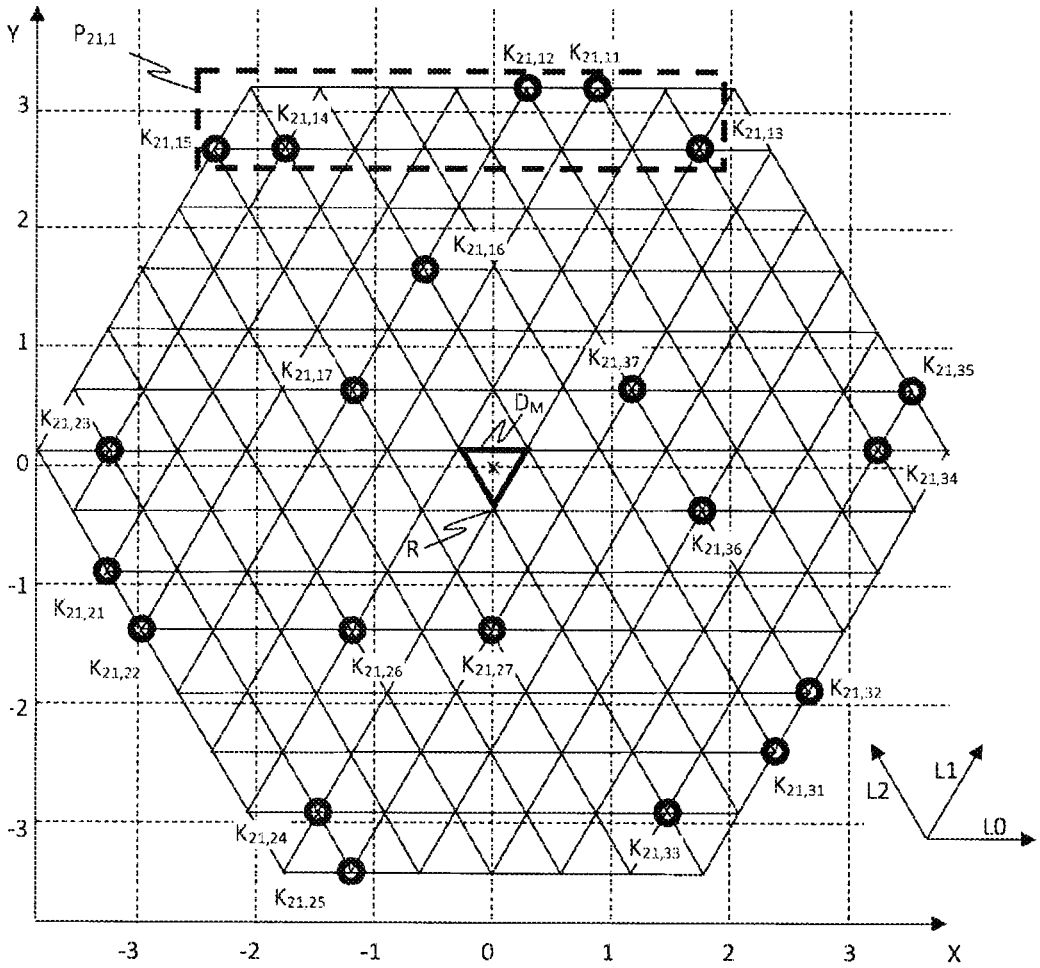
FIG. 5 shows an arrangement of twenty-one microphone capsules in a third embodiment of the invention.

FIG. 5 shows an arrangement of twenty-one microphone capsules, in a third embodiment of the invention. To this embodiment, the same applies as to the first and second embodiments described above. In particular, it has similar advantages. However, the quality of the sound recording may be even better due to the larger number of microphone capsules. Starting from the reference point R, which is defined as described above, and with the coordinate systems indicated in FIG. 5, the microphone capsules are at the following positions (wherein here, too, equivalent variants can be generated by mirroring on an axis and/or by rotating):

| Branch 1: | | Branch 2: | | Branch 3: | |
|---|---|---|---|---|---|
| $K_{21,11}$ | (0, 5, 2) | $K_{21,21}$ | (−5, −1, 0) | $K_{21,31}$ | (2, 0, −4) |
| $K_{21,12}$ | (0, 4, 3) | $K_{21,22}$ | (−4, −2, 0) | $K_{21,32}$ | (3, 0, −3) |
| $K_{21,13}$ | (0, 6, 0) | $K_{21,23}$ | (−5, 0, 1) | $K_{21,33}$ | (0, 0, −5) |
| $K_{21,14}$ | (0, 0, 6) | $K_{21,24}$ | (0, −5, 0) | $K_{21,34}$ | (5, 1, 0) |
| $K_{21,15}$ | (−1, 0, 6) | $K_{21,25}$ | (0, −5, −1) | $K_{21,35}$ | (5, 2, 0) |
| $K_{21,16}$ | (0, 1, 3) | $K_{21,26}$ | (−1, −2, 0) | $K_{21,36}$ | (3, 0, 0) |
| $K_{21,17}$ | (−1, 0, 2) | $K_{21,27}$ | (1, −2, 0) | $K_{21,37}$ | (1, 2, 0) |

The microphone capsules can be distributed very compactly, for example on two boards per branch. One option for one of the circuit boards $P_{21,1}$ with five capsules $K_{21,11}$-$K_{21,15}$ of the first branch is depicted in FIG. 5. The other two capsules $K_{21,16}$,$K_{21,17}$ are close together and can therefore also be mounted very compactly on a second circuit board (not shown). The necessary further electronic components (processor, AD-converter etc.) may be accommodated on one of the two boards and/or on a possible further, central board (not shown) in the middle of the array. Also in this case, the other two branches are congruent, rotated by 120° each, and can use the same type of boards (i.e., boards having the same layout) as the first branch. An optional central board can be jointly used. Also in this embodiment it is possible that at least the capsule-carrying circuit boards make up less than half of the total area of the array (depending on the space required by the other components).

Note that only a relative scale is indicated in FIG. 5. This results from the fact that the arrays according to the invention (in all embodiments) are scalable in size without the occurrence of disruptive and difficult to calculate non-linear effects. For the embodiment shown in FIG. 5, the radius $r_{max}$ of the outermost capsules is approximately L*6.11, with L being the side length of the isometric triangles, and the maximum inter-element spacing is approx. $d_{max}$=L*11.79. For example, with a scale of L=5 cm and a circular shape of the array, a diameter D of approx. 61.1 cm results ($d_{max}$=58.95 cm); with a scale of L=4 cm, a diameter D of approx. 48.9 cm results ($d_{max}$=47.16 cm), and with a scale of L=3.5 cm, a diameter D of approx. 42.8 cm results ($d_{max}$=41.27 cm). Vice versa, the diameter of the array or the maximum inter-element spacing may be given. For example, to obtain a diameter of the array of approx. 55 cm, the scale L=4.5 cm is to be chosen, and a maximum inter-element spacing of e.g. $d_{max}$=40 cm results for approx. L=3.39 cm. Arrays of different sizes do not differ fundamentally in their frequency behavior, but only the frequency range is slightly shifted. As is well known, the maximum inter-element spacing is important for the localizability of sound sources and the generation of directivity at low frequencies, while the minimum inter-element spacing (i.e., the scale L) is important for the localizability and the generation of directivity at high frequencies. Overall, depending on the embodiment, a scale of L=3-6 cm can be useful for speech frequencies, in particular in the range L=4-5 cm.

Corresponding relationships with regard to scalability also apply to the other embodiments. For example, $r_{max}$=L*3.512, D=L*7.024 and $d_{max}$=L*6,557 (rounded) applies to the first and second embodiment.

Figure 6:
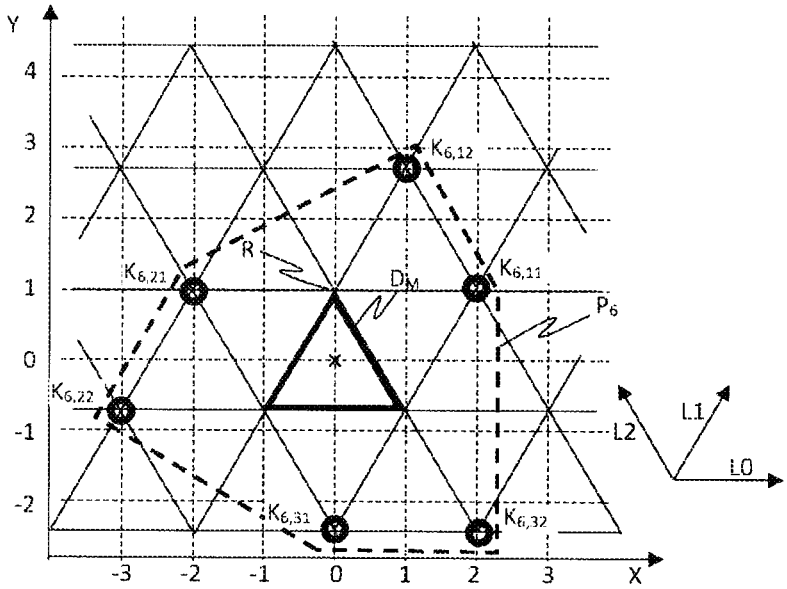
FIG. 6 shows an arrangement of six microphone capsules in a fourth embodiment of the invention.

FIG. 6 shows an arrangement of six microphone capsules, in a fourth embodiment. This variant is particularly suitable for very small microphone arrays that can be placed, for example, on a conference table, while the embodiments described above are well suited for mounting on ceilings and walls. For this variant, the quality of the directivity and the localization of the sound sources are not as good as for the above-described variants due to the small number of microphone capsules, but better than for other comparable arrangements with only six capsules. Starting from the reference point R, which is defined as described above, and with the coordinate systems indicated in FIG. 6, the microphone capsules lie on the following positions (wherein equivalent variants can be generated here, too, by mirroring on an axis and/or by rotating):

| Branch 1 | | Branch 2: | | Branch 3 | |
|---|---|---|---|---|---|
| $K_{6,11}$ | (1 , 0, 0) | $K_{6,21}$ | (−1 , 0, 0) | $K_{6,31}$ | (0, −1 , −1 ) |
| $K_{6,12}$ | (0, 1 , 0) | $K_{6,22}$ | (−1 , −1 , 0) | $K_{6,32}$ | (0, 0, −2) |

The microphone capsules can in this case be distributed to one circuit board per branch or, because of the small overall size, they can all be mounted on a single circuit board $P_6$. Resulting values are (rounded) $r_{max}$=L*1.527, D=L*3.054 and $d_{max}$=L*2.646.

Figure 7:
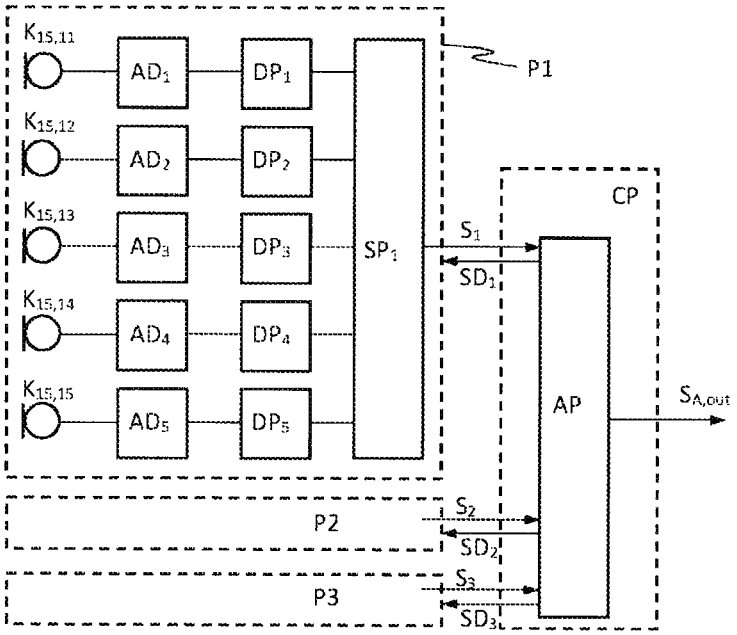
FIG. 7 shows a block diagram of a microphone array.

FIG. 7 shows an exemplary block diagram of a microphone array which may, for example, correspond to the first or second embodiment. Other embodiments have a different number of microphone capsules per branch and/or a further subdivision of the circuit boards into sub-boards. Three circuit boards P1,P2,P3 are each structured identically and, rotated by 120° against each other, arranged on the carrier T, as shown in FIG. 1 and FIG. 4. Each of these boards comprises the same number of microphone capsules $K_{15,11}$-$K_{15,15}$, the signals of which are provided to the respective analog-to-digital converters $AD_1$-$AD_5$, which are also located on the same board. This makes the connection of the sensitive analog microphone signal to the AD-converter very short. Optionally, individual digital processing blocks $DP_1$-$DP_5$ and/or common processing blocks $SP_1$ may be present on the board, e.g. processors. These may filter the digitized microphone signals, for example. Digital output signals $S_1$-$S_3$ of the boards are provided to a central board CP, where a processing unit performs the audio processing AP of the array, in particular the beamforming. Further, the audio processing AP of the array may perform an acoustic search of a (main) sound source in real time in order to align the resulting beam of the array in the direction of the (main) sound source. For this purpose, it may optionally report signals $SD_1$-$SD_3$ back to the boards P1-P3. The resulting digital output signal $S_{A,out}$ of the array is output. Optionally, also an analog output signal may be output.

Because all microphone capsules of a branch are attached together on a circuit board or group of circuit boards and the positioning of the circuit boards on the carrier T can also take place with very little deviation, the relative position of the capsules to one another is very accurate. The carrier may comprise, e.g., one or more solid or sound-reflecting plates made of metal, plastic or the like. In an embodiment, the carrier is a metal or plastic plate with holes through which the sound can reach the microphone capsules (in the ceiling microphone from the bottom when installed). The plate in that case is sound reflecting, so that the sound pressure level at the microphone capsules is increased by up to 6 dB and the array works as a boundary microphone. On the other hand, the arrangement of the microphone capsules according to the invention allows small deviations from the predefined position of up to 0.5 mm, for example, which makes assembly easier and therefore cheaper. Conventionally, a higher degree of accuracy is necessary here in order to achieve a certain audio quality. The microphone capsules can also be mounted on at least two groups of three identical (sub-) boards $PCB_{1,1}$-$PCB_{3,2}$ each, with one board of each group belonging to each branch. Each (sub-) board may comprise at least two microphone capsules. A middle region of the array between the three rotated boards or groups of boards may comprise no board, or a board without a microphone capsule. Alternatively, there may also be an additional microphone capsule in the middle, which increases the total number of capsules. The other positions remain unchanged. Thus, the modified first and second embodiments have sixteen microphone capsules, the modified third embodiment has twenty-two capsules and the modified fourth embodiment has seven capsules. Such center capsule has the advantage that it acquires a sound signal at the position of the highest sound pressure (dynamic pressure) and thus improves the directivity and the SNR for the entire array. However, such additional central capsule is not located on a point of the L2-lattice and therefore leads to an unsymmetric coarray with holes, so that the array gets an uneven directivity and is not easily scalable in size anymore.

Electret capsules are particularly suitable as microphone capsules. Each microphone signal may be corrected or normalized individually, e.g. by means of filtering in the individual digital processing blocks $DP_1$-$DP_5$. The corresponding filtering parameters depend on characteristics of the respective microphone capsule, for example its phase response and frequency response. Therefore, in particular such electret capsules are well suited that have an internal memory element with corresponding correction data from which filter parameters may be determined. In addition, the filter parameters can be influenced by the examined or detected direction of the sound source (i.e. the localization of the sound sources or the beamforming). The localization of sound sources and the actual recording of sound from the main sound source can be two separate processes. It is possible to use only some of the microphone capsules for the localization in order to keep the processing effort low while using all capsules for the actual sound recording.

An advantage of the microphone arrays according to the invention is the good directivity and the high SNR, i.e. a good noise suppression. Noise suppression is the more difficult the less microphone signals are available. However, this relationship is non-linear, depending, among other things, on the positions of the microphone capsules, and therefore difficult to predict. In particular the microphone arrays according to the invention that have fifteen or twenty-one microphone capsules show a good and uniform directivity over all relevant frequency components and directions of incidence of the sound, or a very good noise suppression given the small number of microphone capsules, and are particularly well-suited for ceiling mounted microphones.

The invention claimed is:

1. A microphone array, comprising:

fifteen or twenty-one microphone capsules ($K_{15,11}$-$K_{15,35}$, $K_{21,11}$-$K_{21,37}$); and a circuit arrangement, which is connected to the microphone capsules so as to receive microphone signals from the microphone capsules, and which is configured for processing the microphone signals together;

wherein the microphone capsules are arranged in a plane on a carrier, characterized in that the microphone capsules are positioned on the carrier at the following positions:

on three identical branches, each having the same number of microphone capsules, wherein the branches are rotated against one another by 120° around a common center; and wherein, in a planar isometric coordinate system with three axes rotated by 60° against each other and forming an isometric coordinate system of equilateral triangles, each of the microphone capsules lies on a corner of a triangle of the isometric coordinate system, wherein the geometric center of the array is located in the middle of one of the triangles, which is the center triangle, and wherein positions within the isometric coordinate system are specified as multiples of the side lengths of the triangles in the format and relative to a reference point at that corner of the center triangle which lies opposite its side running parallel to one of the axes, and wherein the microphone array comprises fifteen microphone capsules ($K_{15,11}$-$K_{15,35}$), which, starting from the reference point, are arranged at the following positions, or at the corresponding positions in a mirrored arrangement:

$K_{15,11}$=(0,4,0), $K_{15,12}$=(1,3,0), $K_{15,13}$=(2,2,0), $K_{15,14}$=(0,2,2), $K_{15,15}$=(0,2,1), $K_{15,21}$=(0,0,−3), $K_{15,22}$=(0,−1,−2), $K_{15,23}$=(0,−2,−1), $K_{15,24}$=(2,0,−1), $K_{15,25}$=(1,0,−1), and $K_{15,31}$=(−3,0,1), $K_{15,32}$=(−2,0,2), $K_{15,33}$=(−1,0,3), $K_{15,34}$=(−2,−1,0), $K_{15,35}$=(−2,0,0).

2. The microphone array according to claim 1, wherein the side length of each triangle of the isometric coordinate system corresponds to the smallest distance between two of the microphone capsules.

3. The microphone array according to claim 1, wherein the microphone capsules are mounted on three similar circuit boards or groups of circuit boards rotated by 120° against each other.

4. The microphone array according to claim 3, wherein the microphone capsules are mounted on at least two groups of three similar circuit boards each, wherein each circuit board comprises at least two microphone capsules and wherein one circuit board from each group belongs to each branch.

5. The microphone array according to claim 3, wherein a middle region of the array, between the three rotated circuit boards or groups of circuit boards comprises no circuit board, or a circuit board without a microphone capsule.

6. The microphone array according to claim 1, wherein the signal processing performs beamforming.

7. The microphone array according to claim 1, wherein the microphone array is adapted for being mounted on a ceiling of a room;

the carrier is a metal plate with a sound reflecting surface; and each of the microphone capsules is attached near a hole in the metal plate so as to acquire the sound through the hole.

8. The microphone array according to claim 1, wherein the side lengths of the triangles of the isometric coordinate system are in the range of 3-6 cm, in particular in the range of 4-5 cm.

9. A microphone array, comprising:

fifteen or twenty-one microphone capsules ($K_{15,11}$-$K_{15,35}$, $K_{21,11}$-$K_{21,37}$); and a circuit arrangement, which is connected to the microphone capsules so as to receive microphone signals from the microphone capsules, and which is configured for processing the microphone signals together;

wherein the microphone capsules are arranged in a plane on a carrier, characterized in that the microphone capsules are positioned on the carrier at the following positions:

on three identical branches, each having the same number of microphone capsules, wherein the branches are rotated against one another by 120° around a common center; and wherein, in a planar isometric coordinate system with three axes rotated by 60° against each other and forming an isometric coordinate system of equilateral triangles, each of the microphone capsules lies on a corner of a triangle of the isometric coordinate system, wherein the geometric center of the array is located in the middle of one of the triangles, which is the center triangle, and wherein positions within the isometric coordinate system are specified as multiples of the side lengths of the triangles in the format and relative to a reference point at that corner of the center triangle which lies opposite its side running parallel to one of the axes, wherein the microphone array comprises twenty-one microphone capsules ($K_{21,11}$-$K_{21,37}$), which, starting from the reference point, are arranged at the following positions, or at the corresponding positions in a mirrored arrangement:

$K_{21,11}$=(0,5,2), $K_{21,12}$=(0,4,3), $K_{21,13}$=(0,6,0), $K_{21,14}$=(0,0,6), $K_{21,15}$=(−1,0,6), $K_{21,16}$=(0,1,3), $K_{21,17}$=(−1,0,2);

$K_{21,21}$=(−5,−1,0), $K_{21,22}$=(−4,−2,0), $K_{21,23}$=(−5,0,1), $K_{21,24}$=(0,−5,0), $K_{21,26}$=(−1,−2,0), $K_{21,27}$=(1,−2,0); and $K_{21,31}$=(2,0,−4), $K_{21,32}$=(3,0,−3), $K_{21,33}$=(0,0,−5), $K_{21,34}$=(5,1,0), $K_{21,35}$=(5,2,0), $K_{21,36}$=(3,0,0), $K_{21,37}$=(1,2,0).

* * * * *